US009010893B1

(12) United States Patent
Mizes et al.

(10) Patent No.: US 9,010,893 B1
(45) Date of Patent: Apr. 21, 2015

(54) SYSTEM AND METHOD FOR PROCESS DIRECTION REGISTRATION BETWEEN MULTIPLE INKJETS IN AN INKJET PRINTER

(71) Applicant: Xerox Corporation, Norwalk, CT (US)

(72) Inventors: Howard A. Mizes, Pittsford, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/153,893

(22) Filed: Jan. 13, 2014

(51) Int. Cl.
*B41J 29/38* (2006.01)
*B41J 29/393* (2006.01)
*B41J 2/045* (2006.01)

(52) U.S. Cl.
CPC ..... *B41J 29/393* (2013.01); *B41J 2/04588* (2013.01); *B41J 2/04591* (2013.01); *B41J 2/0459* (2013.01)

(58) Field of Classification Search
CPC .. B41J 2/04588; B41J 2/0459; B41J 2/04591; B41J 2/17546; B41J 29/393
USPC ..... 347/9, 10, 11, 12, 13, 19
See application file for complete search history.

(56) References Cited

U.S. PATENT DOCUMENTS 8,300,266 B2 10/2012 Yeh et al.
2007/0019008 A1 1/2007 Snyder et al.

*Primary Examiner* — Henok Legesse
(74) *Attorney, Agent, or Firm* — Maginot Moore & Beck LLP

(57) ABSTRACT

A method for operating an inkjet printer includes forming a printed mark with a plurality of inkjets in a printhead, generating scanned image data of the printed mark, and modifying an image data correction parameter and firing signal waveform parameter for one of the inkjets to correct a process direction registration error between the locations of ink drops from the one inkjet and the location of the printed mark. The image data correction parameter modifies the location of ink drops from the one inkjet by an integer number of pixels and the firing signal waveform parameter modifies the location of ink drops from the one inkjet by a fractional pixel to enable registration of the inkjet.

18 Claims, 6 Drawing Sheets

SYSTEM AND METHOD FOR PROCESS DIRECTION REGISTRATION BETWEEN MULTIPLE INKJETS IN AN INKJET PRINTER

TECHNICAL FIELD

This disclosure relates generally to printers and, more specifically, to inkjet printers that eject ink drops onto image receiving members to form printed images.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to produce liquid ink for ejection onto the imaging member. The printer supplies ink to printheads for ejection through inkjets onto an image receiving surface of an image receiving member, such as a print medium or an indirect imaging belt or imaging drum. Liquid inks dry and phase change inks cool into a solid state after being transferred to a print medium, such as paper or any other suitable medium for printing.

A typical inkjet printer uses one or more printheads with each printhead containing an array of individual nozzles through which drops of ink are ejected by inkjets across an open gap to an image receiving member to form an ink image. The image receiving member can be a continuous web of recording media, a series of media sheets, or the image receiving member can be an indirect image receiving member, such as a print drum or endless belt. Images printed on indirect image receiving members are later transferred to recording media by mechanical force in a transfix nip formed by the rotating surface and a transfix roller.

In an inkjet printhead, individual piezoelectric or electrostatic actuators generate mechanical forces that expel ink through an aperture, usually called a nozzle, in a faceplate of the printhead. The actuators expel an ink drop in response to an electrical signal, sometimes called a firing signal, activating an actuator. The amplitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that must be operated to eject a pattern of ink drops at particular locations on the image receiving member to form an ink image corresponding to the image data.

In order for the printed images to correspond closely to the image data, both in terms of fidelity to the image objects and the colors represented by the image data, the printheads are registered with reference to the imaging surface and with the other printheads in the printer. In a printer with multiple printheads, the individual inkjets within each printhead are registered with reference to each other and the printheads are registered with reference to each other to enable the printer to form printed images using one or more colors of ink from multiple printheads. In a single printhead, a process direction registration process adjusts the time at which different inkjets eject ink drops to enable the printhead to eject the ink drops onto predetermined locations of an image receiving surface to form, for example, continuous lines that extend in the cross-process direction with a series of ink drops that are substantially collinear to each other.

While the existing solutions for drop placement adjustment correct for some drop placement errors, the existing solutions often lack precision in registration between multiple inkjets in a printhead. For example, existing registration processes use time adjustment corrections that modify the operation of the inkjet by time increments that correspond to an integer size of the printed drops on the image receiving surface. The registration errors between inkjets often include non-integer or fractional errors that cannot be fully corrected by existing registration processes. Consequently, improvements to registration processes for inkjets in printers that enable registration between inkjets that have fractional drop size errors would be beneficial.

SUMMARY

In one embodiment, a method of operating an inkjet printer enables printing of images with improved process direction drop placement precision. The method includes moving with a transport an image receiving surface in a process direction past a plurality of inkjets in at least one printhead, the plurality of inkjets being arranged in a cross-process direction, ejecting a plurality of ink drops from the plurality of inkjets to form a printed test pattern on the image receiving surface, generating with an optical sensor image data of the printed test pattern, identifying with a controller a plurality of locations of a plurality of printed marks in the test pattern from the image data, each printed mark being formed by one inkjet in the plurality of inkjets, identifying with the controller a process direction offset for each inkjet in the plurality of inkjets with reference to the location of each printed mark in the test pattern formed by each inkjet and a predetermined location on the image receiving surface, modifying with the controller an image data correction parameter associated with image data that correspond to each inkjet in the plurality of inkjets to reduce a first portion of the identified process direction offset for each inkjet, modifying with the controller a firing signal waveform parameter associated with each inkjet in the plurality of inkjets to reduce a second portion of the identified process direction offset for each inkjet, and storing with the controller the modified image data correction parameters and the modified firing signal waveform parameters in a memory for use in operating the plurality of inkjets to eject ink drops with reduced process direction offset between the ink drops ejected plurality of inkjets.

In another embodiment, an inkjet printer is configured to eject ink drops with improved process direction drop placement precision. The printer includes a printhead with a plurality of inkjets arranged in a cross-process direction and configured to eject ink drops onto an image receiving surface that moves in a process direction, a transport configured to move the image receiving surface in the process direction past the printhead, an optical sensor configured to generate image data of the ink drops from the printhead that are formed on the image receiving surface, a memory configured to store a plurality of image data correction parameters and a plurality of firing signal waveform parameters, each image data correction parameter and firing signal waveform parameter being associated with one inkjet in the plurality of inkjets, and a controller operatively connected to the printhead, the optical sensor, and the memory. The controller is configured to operate the transport to move the image receiving surface in the process direction past the plurality of inkjets in the printhead, generate a plurality of electrical firing signals for the plurality of inkjets in the printhead to eject a plurality of ink drops to form a printed test pattern on the image receiving surface, generate with the optical sensor image data of the printed test pattern, identify a plurality of locations of a plurality of printed marks in the test pattern from the image data, each printed mark being formed by one inkjet in the plurality of inkjets, identify a process direction offset for each inkjet in the plurality of inkjets with reference to the location of each printed mark in the test pattern formed by each inkjet and a predetermined location on the image receiving surface, modify an image data correction parameter associated with image data that correspond to each inkjet in the plurality of inkjets to reduce a first portion of the identified process direction offset for each inkjet, modify a firing signal waveform parameter associated with each inkjet in the plurality of inkjets to reduce a second portion of the identified process direction offset for each inkjet, and store the modified image data correction parameters and the modified firing signal waveform parameters in a memory for use in operating the plurality of inkjets to eject ink drops with reduced process direction offset between the ink drops ejected plurality of inkjets.

BRIEF DESCRIPTION OF THE DRAWINGS

The foregoing aspects and other features of a printer that is configured to modify image data correction parameters and waveform parameters for registration of inkjets in a printer are described below.

DETAILED DESCRIPTION

Figure 1:
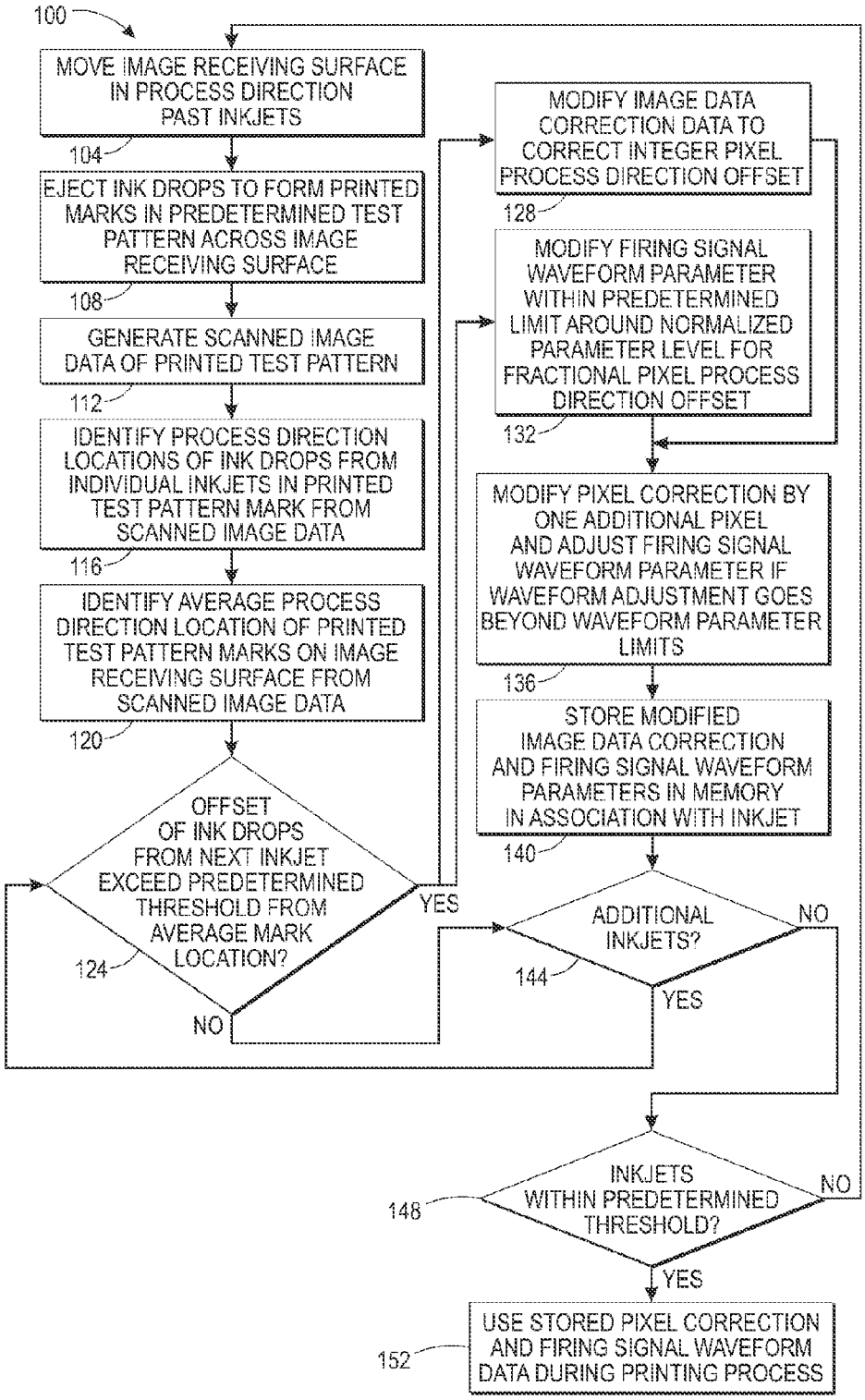
FIG. 1 is a block diagram of a registration process for inkjets in a printer that modifies image data correction parameters and firing signal waveforms to correct for errors in process direction positions of ink drops that are ejected from inkjets in a printer.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving member. For example, ink can be aqueous ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving member, such as a print medium or an intermediate member that holds a latent ink image, moves past the printheads in a process direction through the print zone. The inkjets in the printheads eject ink drops in rows in a cross-process direction, which is perpendicular to the process direction across the image receiving member. An individual inkjet in a printhead ejects ink drops that form a line extending in the process direction as the image receiving surface moves past the printhead in the process direction.

As used herein, the terms "electrical firing signal," "firing signal," and "electrical signal" are used interchangeably to refer to an electrical energy waveform that triggers an actuator in an inkjet to eject an ink drop. Examples of actuators in inkjets include, but are not limited to, piezoelectric, and electrostatic actuators. A piezoelectric actuator includes a piezoelectric transducer that changes shape when the firing signal is applied to the transducer. The transducer proximate to a pressure chamber that holds liquid ink, and the change in shape of the transducer urges some of the ink in the pressure chamber through an outlet nozzle in the form of an ink drop that is ejected from the inkjet. In an electrostatic actuator, the ink includes electrically charged particles. The electrical firing signal generates an electrostatic charge on an actuator with the same polarity as the electrostatic charge in the ink to repel ink from the actuator and eject an ink drop from the inkjet.

As used herein, the term waveform parameter refers to a property of an electrical firing signal that is modified to adjust the velocity of an ink drop that is ejected from an inkjet. Two examples of waveform parameters are the amplitude and pulse width of the firing signal. As used herein, the term "amplitude" refers to maximum and minimum peak voltage levels of the electrical firing signal. As described in more detail below, some firing signals include a waveform with both positive and negative voltage peaks. The positive peak voltage level and negative peak voltage level in a firing signal waveform may have the same amplitude or different amplitudes. As used herein, the term "pulse width" refers to the time duration of the firing signal. An electronic control device in the printer adjusts the amplitude of the firing signal waveform within a predetermined range of amplitudes. In some inkjet embodiments, the amplitude and pulse width of the firing signal affects the mass and velocity of the ink drop that is ejected from the inkjet in response to the firing signal. For example, greater amplitudes and pulse widths for the firing signal increases the mass and velocity of the ink drop that is ejected from the inkjet, while lower amplitudes and pulse widths decrease the mass and velocity of the ejected ink drop. A printhead controller adjusts the amplitude, the pulse width, or both the amplitude and the pulse width to modify the velocity of ink drops that are ejected from the inkjets in the printhead. Since the image receiving surface moves in a process direction relative to the inkjet at a substantially constant rate and typically remains at a fixed distance from the inkjet, changes in the velocity of the ejected ink drops affect the relative locations of where the ink drops land on the image receiving surface in the process direction.

As used herein, the term "offset" refers to a spatial distance between a location of a printed mark formed from one or more ink drops on an image receiving surface and another location on the image receiving surface. A "process direction offset" refers to a spatial distance between the printed mark and another location on the image receiving surface in the process direction. In some instances, the offset distance corresponds to a registration error between the measured location of the printed mark and the expected location of the printed mark on the image receiving surface. The expected location may be a location relative to the process direction locations of other printed marks or to a predetermined fiducial mark that is formed on the image receiving surface.

As used herein, the term "pixel" in the context of an image receiving surface refers to a location where an ink drop should land to be part of a printed mark or printed image. A two-dimensional array of pixels that extend in the process direction and the cross-process direction form a grid where some of the locations receive an ink drop and other locations do not receive ink drops to form a printed image. Each pixel on the image receiving surface has a predetermined dimension that corresponds to a resolution of the printed image. For example, a printed image that is formed with a resolution of 600 dots per inch (DPI), which corresponds to a resolution of approximately 236 drops per centimeter, has pixels with a dimension of approximately 42 μm on the image receiving surface. As is known in the art, the sizes of ink drops that are formed on the image receiving surface are not necessarily the same as the sizes of pixels. Since pixels are typically arranged as a grid of squares while ink drops typically spread in a circular pattern, the ink drops are often larger in size than the corresponding pixel locations. The ink drops can merge to form solid printed lines and other solid printed regions in a printed ink image.

In addition to being used in the context of the image receiving surface, the term "pixel" is used to refer to a single element in a two-dimensional array of image data that are used to control the operation of inkjets in a printer to form a printed image. The pixels in the two-dimensional image data correspond to the pixel locations on the image receiving surface. The cross-process direction location of an image data pixel corresponds to an inkjet in an array of inkjets that extend in the cross-process direction in one or more printheads in the print zone. The process direction location of the pixel in the image data corresponds to a time at which the inkjet ejects and ink drop in conjunction with the other inkjets in the printer. During the operation of inkjets in printheads, controllers in the printheads receive binary image data with individual pixels that have one of two values indicating that a particular inkjet should eject an ink drop at a particular time or that the inkjet should not eject an ink drop at the particular time. A clock signal controls the operation of the printhead so that inkjets in the printhead eject ink drops at predetermined times at a predetermined frequency (e.g. 19 KHz or 38 KHz). The printhead controller generates electrical firing signal waveforms to operate one or more inkjets when the binary image data indicate that the inkjets should be operated to form a portion of a printed image.

As used herein, the term "fractional pixel" refers to a unit of distance on the image receiving surface that covers only a portion of a full pixel. As described in more detail below, the registration errors of printed ink drops in the process direction often include non-integer errors. Additionally, a printer can adjust the operation of printheads to modify the process direction locations of printed pixels by a fraction of a pixel. For example, an inkjet may eject ink drops with an error of 2.5 pixels relative to the process direction locations of other inkjets in the printhead. The non-integer 0.5 pixel portion of the error is referred to as a fractional pixel offset.

As used herein the term "firing signal waveform parameter" refers to any modification to the electrical firing signal waveform that a printer performs to adjust the velocity of the ink drops that are ejected from an inkjet in the printer. In one embodiment, a controller modifies the amplitude of the electrical firing signal waveform to adjust the firing signal waveform parameter for an inkjet to correct for fractional pixel offset errors.

As used herein, the term "image data correction parameter" refers to a numeric parameter that a controller in a printer uses to adjust a time at which an inkjet receives electrical firing signals to eject ink drops during a printing operation. In some printer embodiments, the controller modifies the image data correction parameter for individual inkjets to correct integer pixel portions of process direction registration errors between the inkjets.

Figure 6:
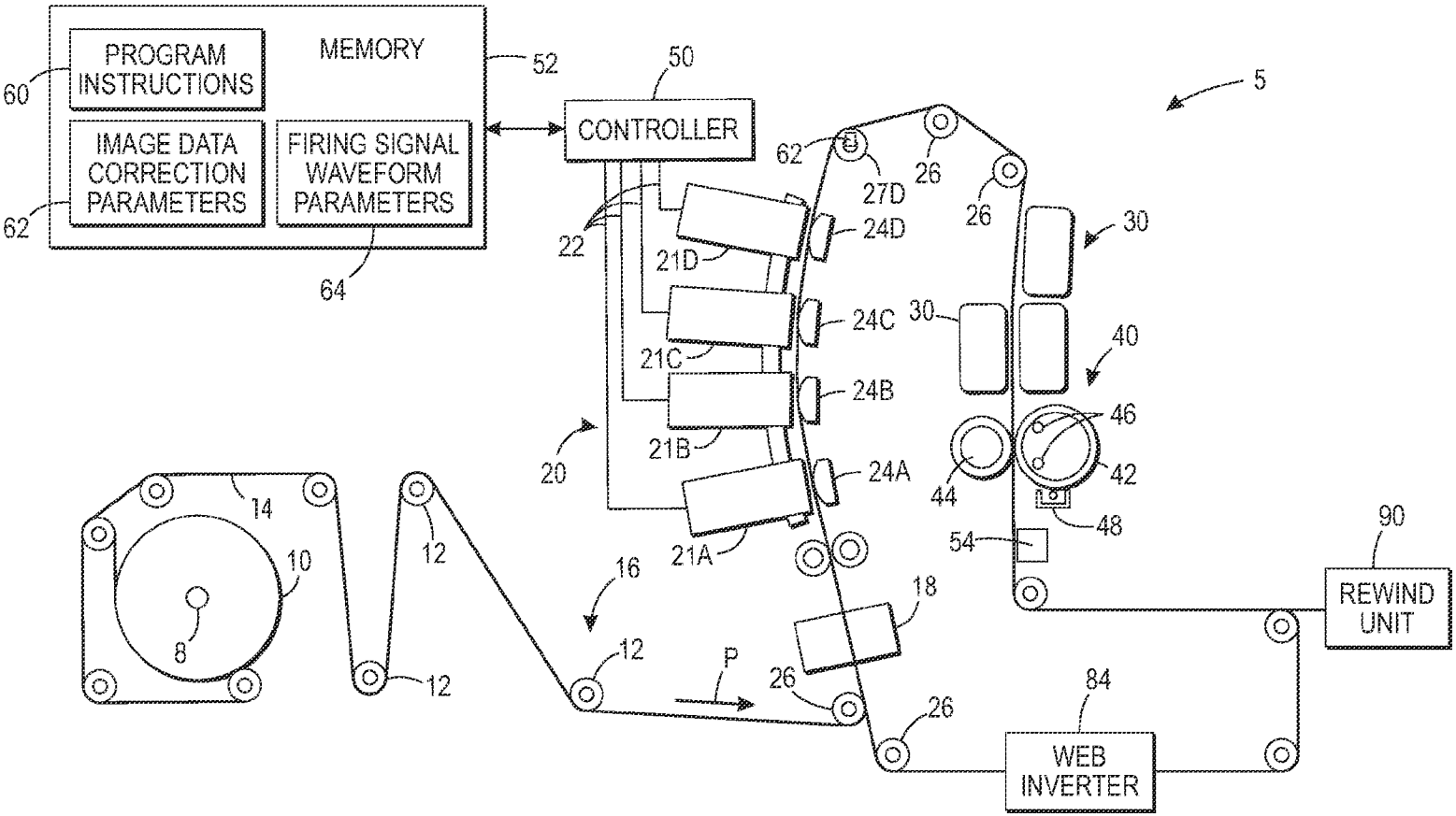
FIG. 6 is a schematic diagram of an inkjet printer that is configured to perform a registration process to correct for process direction errors that include integer pixel offset errors and fractional pixel offset errors between multiple inkjets in the printer.

FIG. 6 is a simplified schematic view of the direct-to-sheet, continuous-media, phase-change inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. For simplex printing, the printer includes the web roller 8, media conditioner 16, print zone or printing station 20, and rewind unit 90. For duplex operations, the web inverter 84 is used to flip the web to present a second side of the media to the printing station 20 before being taken up by the rewind unit 90. In the simplex operation, the media source 10 has a width that substantially covers the width of the rollers 12 and 26 over which the media travels through the printer. In duplex operation, the media source is approximately one-half of the roller widths as the web travels over one-half of the rollers in the printing station 20 before being flipped by the inverter 84 and laterally displaced by a distance that enables the web to travel over the other half of the rollers opposite the printing station 20 for the printing and conditioning, if necessary, of the reverse side of the web. The rewind unit 90 is configured to wind the web onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place ink directly (i.e., without use of an intermediate or offset member) onto the moving media. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

In the printer 5, each of the printhead units 21A-21D includes one or more printhead controllers that generate electrical firing signals to control the operation of the inkjets in each of the printheads. The printheads are configured to eject ink drops at different velocities to enable the formation of uniform printed patterns with process direction registration between the inkjets in each printhead and between different printheads in the print zone 20.

In the illustrative embodiment of FIG. 6, the printer 5 uses four different colors of "phase-change ink," by which is meant that the ink is substantially solid at room temperature and substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjets of the printhead. Alternative embodiments of the printer 5 use aqueous inks that are liquid at room temperature. As used herein, liquid ink refers to melted solid ink, heated gel ink, or other known forms of ink, such as aqueous inks, ink emulsions, ink suspensions, ink solutions, or the like.

Associated with each of the color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 6, each backing member includes a heater that emits thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color modules 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 6, the fixing assembly includes a "spreader" 40, that applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side.

The spreader 40 also includes a cleaning/oiling station 48 associated with image-side roller 42. The station 48 cleans and/or applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature during the printing operation to enable the spreader 40 to spread the ink while the ink is in a liquid or semi-liquid state.

Following passage through the spreader 40 the printed media can be wound onto a roller for removal from the system (simplex printing) or directed to the web inverter 84 for inversion and displacement to another section of the rollers for a second pass by the printheads, mid-heaters, and spreader. The duplex printed material is subsequently wound onto a roller for removal from the system by rewind unit 90. Alternatively, additional processing stations receive the print medium and perform tasks such as cutting, binding, collating, and/or stapling the media or the like.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The memory 52 includes volatile data storage devices such as random access memory (RAM) and non-volatile data storage devices including magnetic and optical disks or solid state storage devices. The processors, their memories, and interface circuitry configure the controllers and/or print engine to perform the functions, such as the difference minimization function, described above. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

As described in more detail below, the controller 50 executes stored program instructions 60 in the memory 52 to form printed patterns on the media web 14 and to identify the reflectance levels of the printed patterns for use in process direction registration of inkjets in one or more of the printheads in the printhead units 21A-21D. The memory 52 also stores image data correction parameter data 62 and firing signal waveform parameter data 64. The image data correction parameter data 62 include offset values stored in association with the inkjets in the printhead units 21A-21D for modification of the time at which each inkjet ejects ink drops. The inkjets in the printheads are operated with a synchronous clock signal, and the image data correction parameter correction parameter corresponds to an integer number of clock cycles that a printhead controller either delays the operation of an inkjet or brings the operation of the inkjet forward in time to correct process direction registration errors for the inkjet. The firing signal waveform parameter data 64 stores settings for the amplitudes of the electrical firing signal waveforms that are generated to operate the individual inkjets in association with each of the inkjets in the printhead units 21A-21D. The firing signal waveform parameter for each inkjet adjusts the velocity of ink drops that are ejected from the inkjet. The printer 5 uses the image data correction parameters to correct integer pixel errors in the process direction registration between inkjets, while the firing signal waveform parameters are used to correct the fractional pixel registration errors.

The printer 5 includes an optical sensor 54 positioned after the print zone. In the printer 5, the optical sensor 54 is located after the spreader 40 in the process direction P. In other embodiments, the optical sensor is located before the spreader and/or mid-heater on the media path. The optical sensor 54 is configured to detect, for example, the presence, reflectance levels, and/or location of ink drops jetted onto the web media by the inkjets of the printhead assembly. In one embodiment, the optical sensor 54 includes a light source and a linear array of light detectors. The light source can be a single light emitting diode (LED) with a broad spectrum that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS are arranged in a single linear array in a repeating sequence of the three colors. The LEDs of the light source can be coupled to the controller 50 or some other control circuitry to activate the LEDs for image illumination.

The reflected light is measured by the optical detectors in optical sensor 54. The optical sensor, in one embodiment, is a linear array of photosensitive optical detectors, such as charge coupled devices (CCDs) or complementary metal oxide (CMOS) elements. In the printer 5, the optical sensor 54 includes a linear array of more than 12,000 photosensitive optical detectors that extend across the width of the media web 14. Each photosensitive optical detector detects light reflected from an area of the surface of the media web 14 that is approximately one pixel in size. As the media web 14 moves past the optical sensor 54, the optical sensor 54 generates successive lines of image data, referred to as scan lines, that the controller 50 assembles into a two-dimensional array of image data corresponding to a section of the length of the media web 14 in the process direction and the width of the media web 14 in the cross-process direction. The optical detectors in the optical sensor 54 generate measurements of the level of light that is reflected from the media web 14, including bare portions of the media web 14 and portions that are covered with ink drops. In the printer 5, one or more analog to digital converters (ADCs) generate digital data corresponding to the measured reflectance level of light corresponding to each pixel of image data from the optical sensor 54.

FIG. 1 depicts a process 100 for correction of process direction offset between multiple inkjets in a printer using both image data correction parameters and modifications of electrical firing signal waveform parameters for inkjets in the printer. In the discussion below, a description of the process 100 performing a function or action refers to execution of stored program instructions by one or more controllers and processors that operate one or more components in the printer to perform the function or action.

Figure 3:
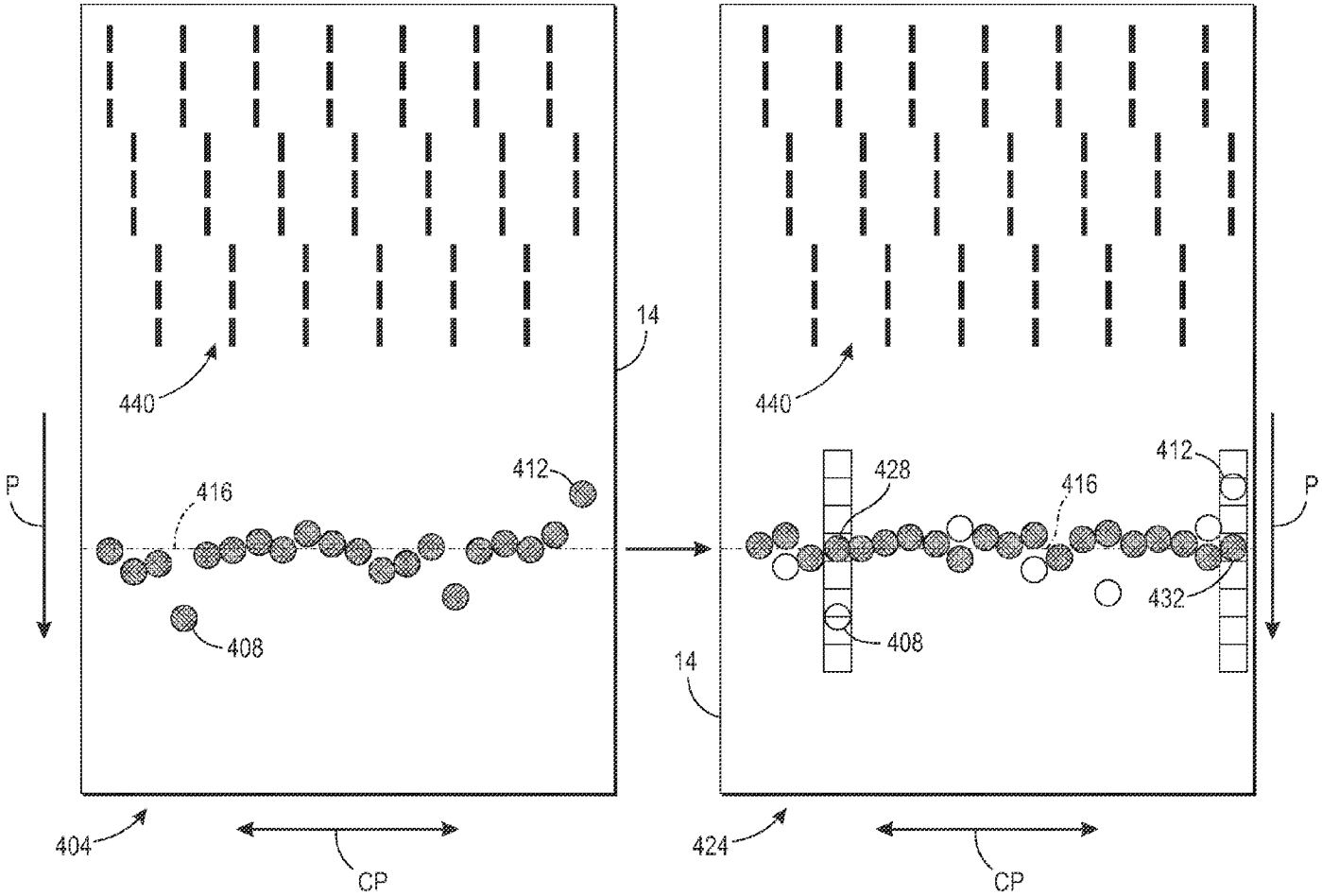
FIG. 3 is a depiction of two printed marks that are formed on a print medium depicting process direction registration between multiple inkjets in a printhead.

Process 100 begins as the printer moves the image receiving surface past a plurality of inkjets in a print zone in a process direction (block 104). In the printer 5, the media transport propels the media web along the process direction using, for example, the rollers 12 and 26 to move the media web 14 past the printhead units 21A-21D. In an indirect printer embodiment, another transport device moves an image receiving surface of an indirect image receiving member, such as a belt or drum, past the printheads. In either embodiment, the transport device includes one or more electrical actuators that move the media or image receiving surface of the image receiving member through the print zone. The printer ejects ink drops from a plurality of inkjets that are arranged in the cross-process direction to form a printed mark on the image receiving surface (block 108). During process 100, the printed mark includes ink drops from a plurality of inkjets in the printhead. The selected inkjets ejects a series of ink drops to form a printed dash on the image receiving surface. The dashes are separated by a predetermined distance in the cross-process direction. The printhead controller controls the time of the ejection so that printed dashes from a set of selected inkjets are aligned in the process direction if the inkjets eject ink drops at substantially the same velocity. In FIG. 3, the printed patterns 440 are examples of printed test patterns that are formed by the same inkjets that form the printed drops including the drops 408, 412, 416, 428 and 432. The inkjets in a single printhead typically receive ink from a single reservoir and the electrical and fluid mechanical properties of the inkjets can produce variations in the placement of ink drops due to interactions between multiple inkjets in the same printhead. The printer 5 performs the process 100 to improve process direction registration between inkjets in one or more printheads in the printhead units 21A-21D.

If the inkjets are properly registered in the process direction, then any two ink drops that are ejected from different inkjets in the printhead with a given digital pixel spacing in the process direction land on the image receiving surface in substantially the same location in the process direction. For example, the printed ink drops are all arranged linearly in one or more rows that extend in the cross-process direction, which indicates that each of the inkjets eject ink drops that land on the image receiving surface with proper process direction registration relative to each other. In more practical embodiments, however, some of the inkjets may eject ink drops that land outside of a predetermined range of the average process direction location for the printed ink drops. FIG. 3 depicts a printed mark 404 that is formed using a plurality of inkjets in a printhead where some of the inkjets are not fully registered in the process direction. The printed mark 404 illustrates the effects of misregistration between inkjets in the printhead. Although the horizontal line illustrated in FIG. 3 is a pattern which shows the strongest signature of a process direction misregistration, alternative patterns are better suited for a measurement of this misregistration. Specifically, a test pattern used to identify the relative process direction locations of the inkjets typically includes a series of series of separate dashes in the process direction from nonadjacent inkjets instead of the continuous printed line of FIG. 3. As depicted in FIG. 3, a printed mark 404 that is formed from a plurality of ink drops on the image receiving surface 14. The ink drops in the printed mark 404 generally form a line that is parallel to the cross-process axis CP, although some of the ink drops in the printed mark have upstream or downstream offsets in the process direction from the average location of the printed mark in the process direction P. As used herein, the term "upstream" refers to a direction of offset for printed ink drops that is against the direction of movement of the image receiving surface in the process direction, while the term "downstream" refers to a direction of offset for printed ink drops that are in the same direction as the direction of movement of the image receiving surface in the process direction. In FIG. 3, the ink drop 408 has a downstream offset downstream in the process direction P from an average process direction of the mark that is depicted by the line 416, while the ink drop 412 has an upstream offset from the average location 416.

Referring again to FIG. 1, the printer generates scanned image data of the printed marks in the test pattern (block 112) and identifies the process direction locations of edges of the printed ink marks in the test pattern in association with the individual inkjets that print each of the marks (block 116). In one embodiment, the controller 50 applies an edge detection kernel to the scanned image data corresponding to the printed marks to identify the relative process direction locations of marks that are printed from the inkjets in the printhead. In the printer 5, the controller 50 receives scanned image data of a larger region of the media web 14 that includes the printed mark 404 from the optical sensor 54. The scanned image data include reflectance values that correspond to pixel locations on the media web 14 including both printed ink drops in the printed mark and bare portions of the media web 14. In one embodiment, the scanned image data include numeric reflectance values that correspond to a detected level of light that each photodetector in the optical sensor 54 receives from a small region of the image receiving surface. Regions of high reflectance correspond to the bare media web 14, while regions of lower reflectance correspond to printed ink drops. The controller 50 uses, for example, edge detection kernels and other image processing techniques to identify the process direction locations of the printed ink marks in the scanned image data. For ink marks that have fractional pixel offsets, the controller 50 identifies the fractional offset using two or more reflectance values from the scanned image data that correspond to different portions of the printed ink drop and an interpolation process to identify a fractional pixel offset for the ink drop in the image receiving surface.

Process 100 continues as the controller 50 identifies an average process direction location of the printed marks in the test pattern using the identified locations of the printed marks from the individual inkjets (block 120). FIG. 3 depicts a printed line in an image that is generated when some of the inkjet are offset in the process direction from the other inkjets in the printhead. The line 416 represents the average process direction location of the ink drops in the printed mark 404. Some of the ink drops are aligned with the average location, such as pixels that are within a predetermined distance of the average location 416. Other printed ink drops, such as the ink drops 408 and 412, have process direction offsets from the average location 416 that exceed a predetermined threshold. The controller 50 uses the average process direction location of the printed marks in the test pattern or the process direction offset from a fiducial mark that is located at a predetermined location on the image receiving surface as a predetermined reference location to identify process direction offset errors for individual inkjets in the printhead. While FIG. 1 illustrates an embodiment of the process 100 that identifies an average location of the printed mark as the predetermined reference location on the image receiving surface, in another embodiment a pre-printed fiducial mark on the image receiving surface is used as the predetermined location. For example, in one embodiment the media web 14 may include fiducial marks that are included in the scanned image data. The fiducial marks are formed at predetermined locations relative to the printed mark, and the controller 50 uses the identified process direction location of the fiducial marks as a reference to identify the relative process direction offsets of ink drops from one or more inkjets that form the printed mark.

Process 100 continues with identification of the process direction offset of the printed ink drops from individual inkjets from the average process direction location of the printed mark. If the offset of the ink drops exceeds a predetermined threshold distance (block 124), then the controller 50 modifies an image data correction parameter to correct an integer portion of the offset error (block 128) and modifies a firing signal waveform parameter within a predetermined range around a normalized setting for the inkjet to correct a fractional-pixel portion of the identified offset (block 132). In one embodiment, the predetermined threshold can be zero and the controller 50 modifies the integer portion of the offset error and the firing signal waveform parameter for all ink drops. Using the example of FIG. 3, the ink drops 408 and 412 are examples of ink drops from two different inkjets that are offset from the average location in the downstream direction and upstream direction, respectively.

To correct integer pixel offset errors, the controller 50 increases or decreases a numeric value of an image data correction parameter that adjusts image data in the process direction to control a time at which the inkjet receives electrical firing signals to eject ink drops. For example, in one embodiment a positive image data correction parameter adjusts a column of image data upstream along the process direction axis to delay the operation of an inkjet if the ink drops from the inkjet land too far downstream on the image receiving surface. A negative image data correction parameter adjusts the image data in the downstream direction of the process direction axis to bring the operation of the inkjet forward in time when the ink drops from the inkjet land too far upstream on the image receiving surface.

Figure 4:
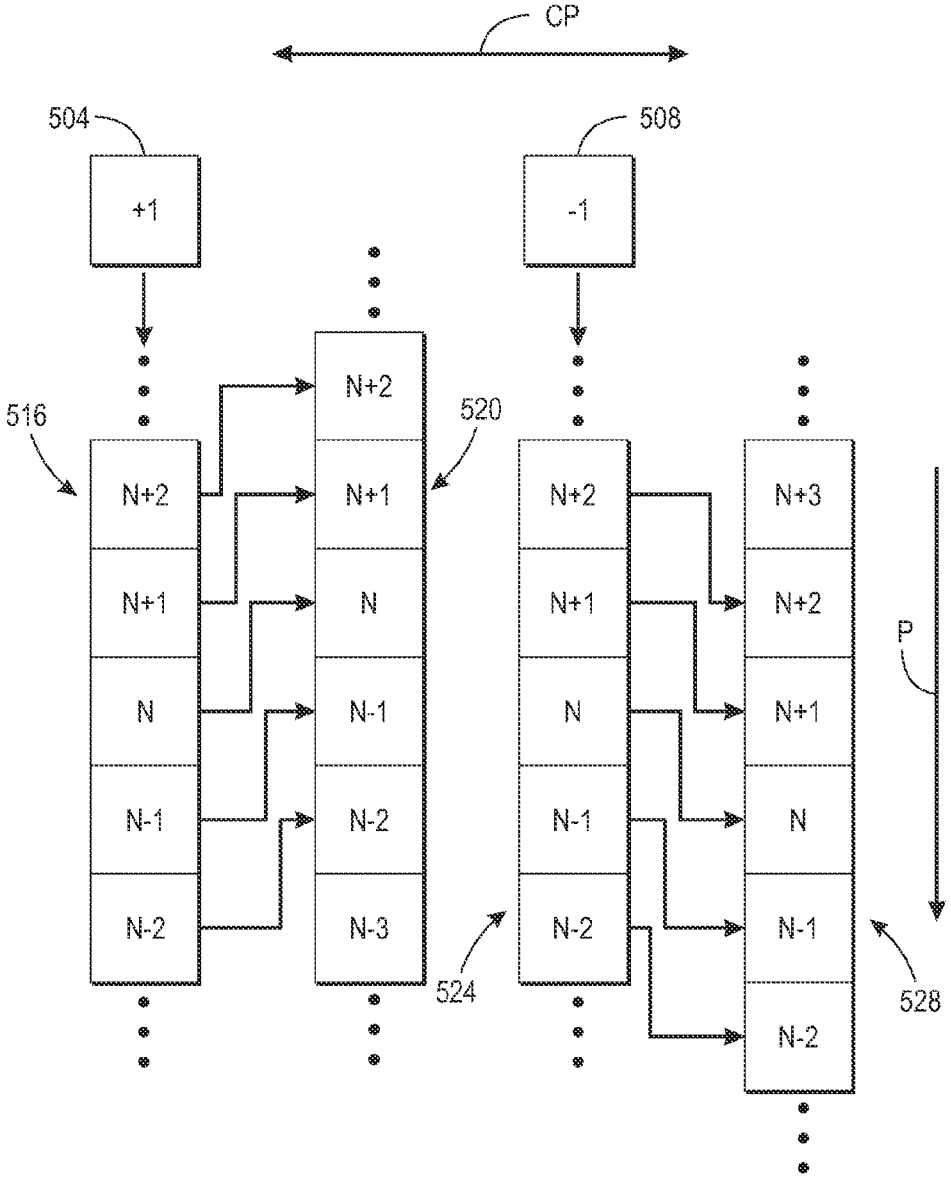
FIG. 4 is a depiction of image data correction parameters and modifications to binary image data corresponding to the image data correction parameters to adjust a time at which an inkjet ejects ink drops during a printing operation.

FIG. 4 depicts two image data correction parameters 504 and 508 that are associated with two different inkjets. The image data correction parameter 504 has a value of "+1", which corresponds to a correction of the image data by one pixel in the upstream direction in the illustrative embodiment of FIG. 4. In FIG. 4, the controller 50 modifies the binary image data in column 516 to generate a modified column of binary image data 520. The binary image data 520 are offset by one pixel in the upstream direction relative to the process direction P. The image data correction parameter 504 effectively delays the operation of the associated inkjet by a predetermined time, such as one clock cycle of the operating clock that is used to control the generation of firing signals for the inkjet. Thus, the image data correction parameter 504 corrects for a one pixel integer portion of a downstream process direction error. In FIG. 4, the image data correction parameter 508 that is associated with another inkjet offsets the binary image data by "−1", which corresponds to a correction of the image data by one pixel in the downstream direction. The controller 50 uses the image data correction parameter 508 to modify the binary image data column 524 and generate the modified binary image data column 528. The printhead controller receives the modified image data column 528 and brings forward the generation of firing signals for the associated inkjet by one clock cycle to correct for an integer portion of an upstream process direction offset error. In the printer 5, the controller 50 retrieves the image data correction parameter, such as the parameter 504 or 508, from the image data correction parameter data 62 in the memory 50 and modifies the parameter value to apply an integer pixel correction to the inkjet.

To correct a non-integer fractional portion of the pixel offset error, the controller 50 modifies a waveform of the electrical firing signal that is used to operate the inkjet. The modification of the electrical firing signal waveform changes the mass and velocity of the ink drops that are ejected from the inkjet. Since the media web 14 moves past the inkjets with substantially constant velocity and at a substantially constant distance from the inkjet, an increase or decreases in the velocity of the ink drops adjusts the relative location of the ink drops in the downstream or upstream directions on the image receiving surface, respectively.

Figure 5:
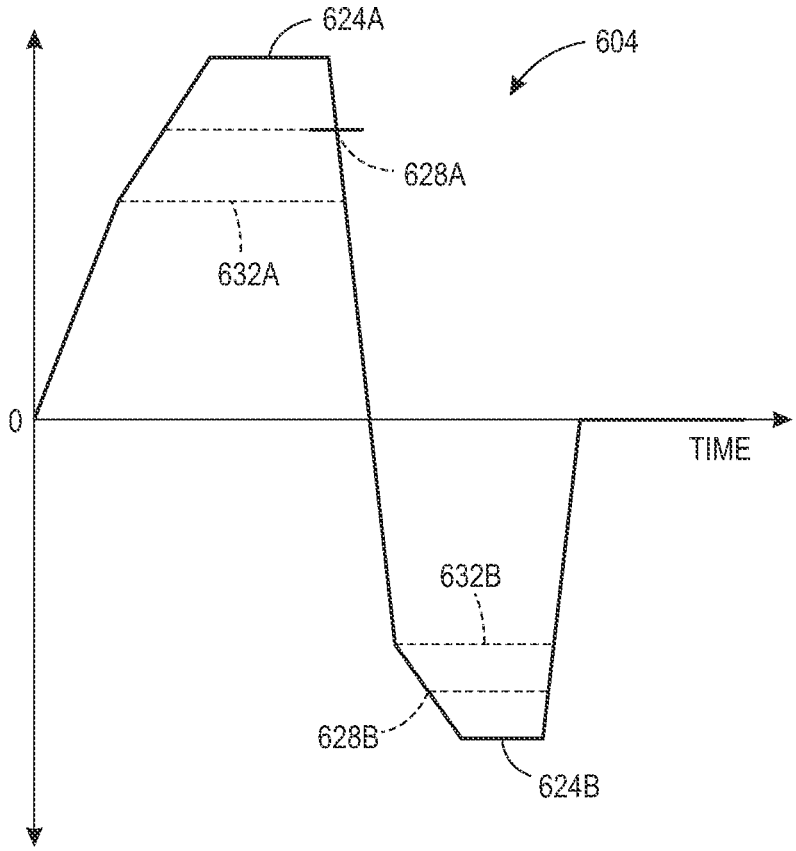
FIG. 5 is a depiction of an electrical firing signal waveform with a waveform amplitude parameter that selected to adjust a velocity of ink drops that are ejected from an inkjet during a printing operation.

FIG. 5 depicts an illustrative firing signal waveform 604. The firing signal waveform includes a positive voltage peak with a maximum positive amplitude 624A and a negative voltage peak with a maximum negative amplitude 624B. The controller 50 modifies an amplitude parameter of the firing signal waveform to adjust the positive peak voltage amplitude level between the maximum positive amplitude 624A and a minimum positive amplitude 632A for the positive peak voltage amplitude, and between the maximum negative amplitude 624B and a minimum negative amplitude 632B. In the printer 5, the firing signal waveforms have a midpoint positive and negative amplitude levels 628A and 628B, respectively, that are halfway between the corresponding minimum and maximum amplitude levels for the firing signal waveform 604.

In the printer 5, the controller 50 generates incremental adjustments to the positive and negative peak amplitudes of the firing signal waveform over a predetermined number of discrete voltage levels. Each incremental increase in the firing signal amplitude increases the velocity of the ink drops from the inkjet and moves the landing locations of the ink drops for the inkjet downstream in the process direction. Each incremental decrease in the firing signal amplitude decreases the velocity of the ink drops from the inkjet and moves the landing locations of the ink drops for the inkjet upstream in the process direction. The controller 50 retrieves the numeric value corresponding to the incremental firing signal waveform amplitude parameter from the firing signal waveform parameter data 64 in the memory 52 and modifies the numeric value to correct the identified fractional pixel error for the inkjet. In an alternative inkjet printer embodiment, the controller increases or decreases a pulse width parameter for the firing signal to increase or decrease the duration of the firing signal within predetermined minimum and maximum time limits. An increase to the pulse width of the firing signal increases the velocity of the ejected ink drops and a decrease to the pulse width decreases the velocity of the ejected ink drops.

During process 100, the controller 50 limits the maximum adjustment level that is applied to the waveform parameter for the inkjet with reference to a predetermined normalized or "normed" value of the waveform parameter. The normalized waveform parameter value is generated during a printhead "norming" process that is known to the art. The norming process is performed to enable the inkjets in the printhead to eject ink drops with substantially uniform drop masses. As is known in the art, variations between average drop mass sizes can result in light or dark streak artifacts in printed images, especially if groups of adjacent inkjets each eject ink drops with larger or smaller ink drop masses than the other inkjets in the printhead.

In the printer 5, the memory 52 stores the normalized waveform parameter data 64 for each inkjet, and the controller 50 modifies the normalized waveform parameter value to adjust the velocity of the printed ink drops. In addition to not exceeding the predetermined maximum and minimum waveform parameter levels that are inherent to the printhead hardware configuration, the controller 50 also limits the maximum modification that is applied to the normalized waveform parameter value that is associated with each inkjet. For example, in one embodiment an incremental adjustment of ten increments to the waveform amplitude parameter results in a one-half pixel adjustment to the location of printed ink drops from an inkjet. However, if the controller 50 enforces a maximum adjustment limit of seven increments, then the sub-pixel waveform adjustment is limited to seven increments when the controller 50 identifies a one-half pixel fractional pixel offset. The predetermined limit is selected to maintain a balance between ink drop placement accuracy and ink drop mass uniformity during printing operations. The controller 50 maintains the waveform parameter for each inkjet within the predetermined limit from the normalized parameter value through one or more iterations of the process 100.

As described above, during process 100 the controller 50 modifies the image data correction parameter to correct for an integer pixel portion of the identified process direction offset error for the inkjet and the firing signal waveform parameter to correct for the fractional pixel portion of the process direction offset error. In some instances, the adjustment to the firing signal waveform parameter may exceed the maximum or minimum amplitude limits for the firing signal waveform. During process 100, the controller 50 modifies the integer pixel offset correction parameter for the image data by one additional pixel and adjusts the firing signal waveform parameter by a different amount to maintain the firing signal waveform parameter within the predetermined limits for the inkjet if the modification to the firing signal waveform parameter exceeds the limits (block 136).

In an illustrative example, the controller 50 identifies an error of 2.3 pixels in the upstream process direction for an inkjet. The controller 50 decreases an image data offset parameter for the inkjet by −2 to correct the integer portion of the error, and would generate an incremental increase in the waveform amplitude for the inkjet to correct the 0.3 pixel fractional pixel error. If, however, the waveform parameter for the inkjet is already at or near the maximum amplitude levels depicted by the peaks 624A and 624B in FIG. 5, then the controller 50 cannot increase the amplitude level any further. Instead, the controller 50 modifies the full pixel image data correction parameter to be −3 instead of −2, and the controller decreases the firing signal waveform amplitude parameter by an incremental amount corresponding to 0.7 pixels (1 pixel-0.3 pixels) in the upstream direction instead of attempting to increase the firing signal amplitude parameter by 0.3 pixels in the downstream direction. The 0.7 pixel adjustment in the upstream direction is within the limits of the firing signal waveform parameter. The net correction remains 2.3 pixels in the downstream direction to correct the identified error. In another example, if a modification of the waveform parameter would produce a waveform amplitude level that is below the minimum waveform amplitude levels 632A and 632B, then the controller 50 modifies the image data correction parameter to increase the integer pixel correction in the upstream direction by one pixel, and the controller 50 increases the amplitude of the firing signal waveform parameter by a fractional amount in the downstream direction to produce the same correction while remaining within the amplitude limits of the firing signal waveform.

Referring again to FIG. 1, process 100 continues as the controller stores the modified image data correction parameters and firing signal waveform parameters in the memory in association with the inkjet (block 140). In the printer 5, the controller 50 stores the image data correction parameter for the inkjet with the image data correction parameter data 62 and the firing signal waveform parameter in the firing signal waveform data 64.

Process 100 continues in an iterative manner for additional inkjets that form the printed mark. If the identified process direction locations for some of the ink drops are within a predetermined distance of the predetermined location (block 124), then the image data correction parameters and firing signal waveform parameters for the inkjet remain unchanged and the process 100 determines whether additional inkjets are to be evaluated (block 144). If additional inkjets are to be evaluated, the offset of the next inkjet ejector is evaluated (block 124). Otherwise, processing continues by determining whether the inkjets are within the predetermined threshold (block 148) as explained in more detail below. If the process direction location of the ink drops from the inkjet is outside of the predetermined range (block 124), then the printer corrects the image data correction and firing signal waveforms as described above with reference to the processing of blocks 128-140.

In the embodiment of FIG. 1, the printer forms a series of printed marks and modifies the image data correction and firing signal waveform parameters for one or more inkjets in an iterative manner until the process direction locations of printed ink drops from all of the inkjets that form the printed mark are within the predetermined threshold (block 148). The printer modifies the image data correction and firing signal waveforms for the inkjets to form printed marks of the process 100 as described with reference the processing in blocks 104-144 in an iterative manner until each of the inkjets ejects ink drops that are within the predetermined threshold distance from the average mark location (block 148). For example, as depicted in FIG. 3, the printed mark 424 includes ink drops that are all within a predetermined process direction distance of the average mark location 416. The printer 5 modifies the image data correction parameters and firing signal waveform parameters for the inkjets that form the ink drops 408 and 412 in the pattern 404 to eject the ink drops 428 and 432 in the printed mark 424 that have correct process direction registration. The printer uses the stored image data correction and firing signal waveform parameters to operate the inkjets during subsequent printing operations to form printed images with improved process direction registration (block 152). The printer 5 performs process 100 using the inkjets in one or more printheads to correct the process direction registration between inkjets in each of the printhead units 21A-21D.

As described above, the printer 5 modifies a firing signal waveform parameter for one or more inkjets to increase or decrease the velocity and corresponding process direction locations of the ink drops on the media web 14 to correct process direction registration errors. The modification to the firing signal waveform parameter also increases or decreases the mass of the ink drops that are ejected from each inkjet. The perceived density of the image is proportional to the mass of the ink drop. Inkjets that eject substantially larger drops produce darker regions in printed images and inkjets that eject substantially smaller drops produce lighter regions. In some circumstances one or more adjacent inkjets where the mass was increased to move the drop downstream will occur resulting in a perceptible dark streak in the image. Likewise, regions will exist where one or more adjacent inkjets where the mass was decreased to move the drop upstream will occur resulting in a perceptible light streak. Both these dark regions and light regions will exist across the print, resulting in an image with degraded uniformity. As described above, during process 100 the printer 5 limits the maximum change in the waveform parameter for each inkjet to limit the changes in the sizes of ink drops from individual inkjets.

Figure 2:
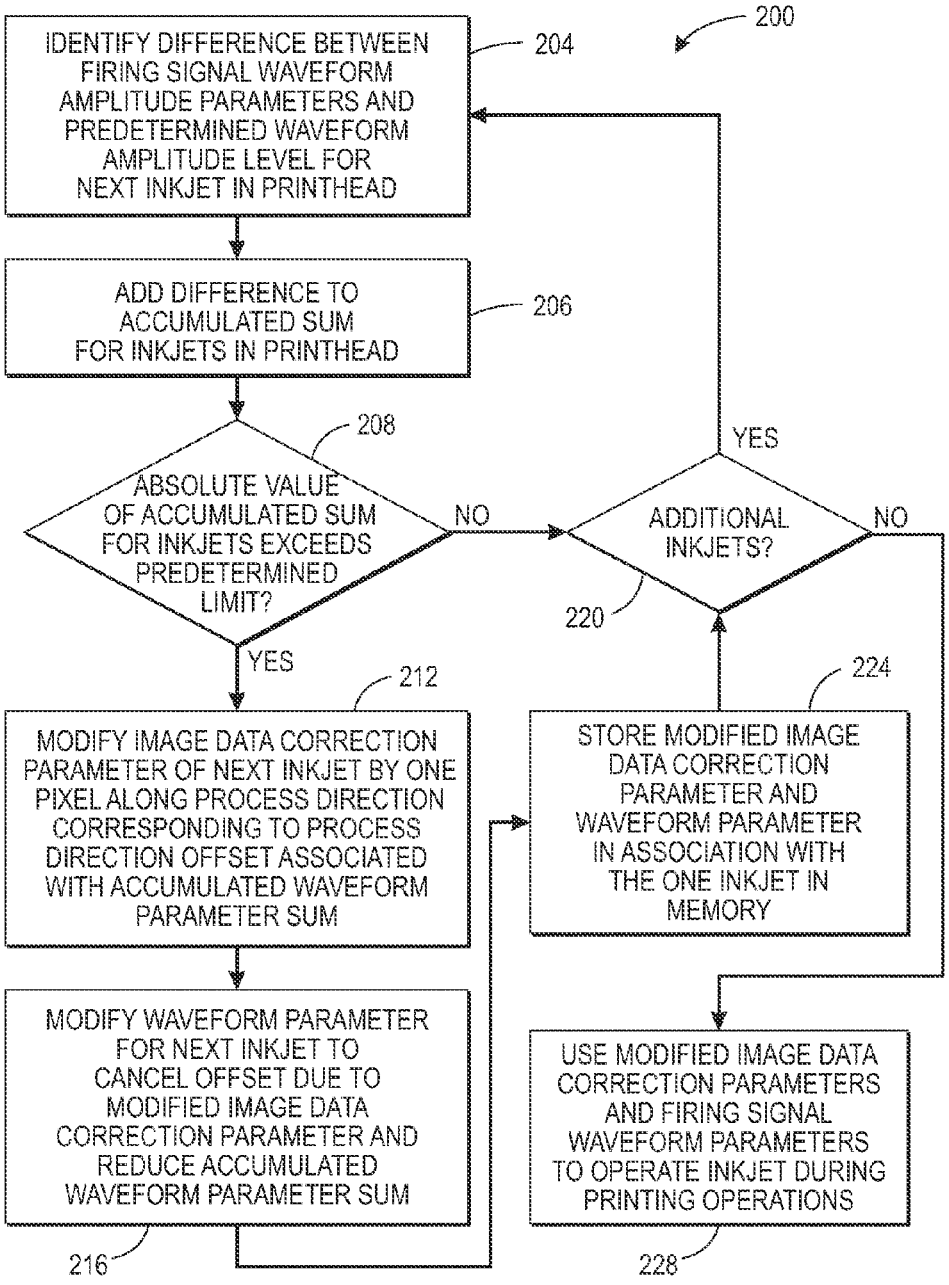
FIG. 2 is a block diagram of an error diffusion process for modifying image data correction parameters and firing signal waveform parameters for inkjets in a printhead to reduce variations in the uniformity of printed images that are formed using the inkjets.

FIG. 2 depicts an error diffusion process 200 for adjusting the firing signal waveform parameters for one or more inkjets to reduce or eliminate the effects of the uniformity degradation. The printer 5 performs the process 200 during or after the process 100 to improve the uniformity of printed patterns that are formed from the printhead while correcting for the process direction registration of the printhead.

FIG. 2 depicts a process 200 for modification of waveform parameters and image data correction parameters for inkjets using an error diffusion process. In the discussion below, a description of the process 200 performing a function or action refers to execution of stored program instructions by one or more controllers and processors that operate one or more components in the printer to perform the function or action. The process 200 is described in conjunction with the printer 5 for illustrative purposes.

During process 200, the controller 50 identifies the difference between the identified waveform amplitude parameter for a selected inkjet and the predetermined normalized level of the inkjet in the printhead (block 204). During process 200, the controller 50 identifies the waveform parameter differences for neighboring inkjets across the printhead in the cross-process direction, and the controller 50 generates a cumulative sum of the identified differences for each iteration of the process 200 (block 206). The controller 50 begins with an initial inkjet that is the first inkjet examined in the cross process direction for a group of inkjets on one or more printheads of a single color during the process 100. As described above, the controller 50 retrieves the waveform amplitude parameter levels for the inkjets from the waveform parameter data 64 in the memory 52. The predetermined waveform parameter level is the normalized waveform parameter that is set at a level between the minimum amplitude level and the maximum amplitude level that produces a drop of the same size as the other drops in the printhead.

During process 200, if the absolute value of the identified cumulative sum remains below a predetermined threshold (block 208), then the controller 50 modifies the cumulative sum by adding the difference between the identified waveform parameter and the predetermined wave form parameter to the cumulative sum (block 220) and process 200 returns to the processing that is described above with reference to block 204. In the embodiment of FIG. 2, if the identified waveform parameter is less than the predetermined waveform parameter then the cumulative sum is decreased, and if the identified waveform parameter is greater than the predetermined waveform parameter then the cumulative sum is increased. The controller 50 increments the cumulative sum as the processing of the waveform patterns continue from the initial inkjet in the cross process direction to the final inkjet in the cross process direction. Thus, the cumulative sum increases whenever nearby inkjets have firing signal waveform amplitude parameters that are either mostly above the predetermined waveform amplitude level. The cumulative sum decreases whenever nearby inkjets have firing signal waveform amplitude parameters that are either mostly below or mostly below the predetermined waveform amplitude level.

If the addition of the difference between the identified waveform parameter and the predetermined waveform parameter to the cumulative sum for the current inkjet exceeds a predetermined threshold (block 208), then the controller 50 modifies an image data correction parameter for the current inkjet in the direction of the process direction offset that is associated with the cumulative sum (block 212) and the controller 50 modifies the waveform parameter associated with the next inkjet to cancel the effect of the modification to the image data correction parameter and reduce the magnitude of the cumulative sum (block 216). For example, if 20 increments of the waveform adjustment parameter adjust the process direction location of ink drops by one pixel, the value of the cumulative sum is 18 before the current inkjet is examined, the predetermined threshold is 20 units, and the current inkjet requires an adjustment of the waveform adjustment parameter 8 increments higher, then the cumulative sum would be 26, which exceeds the threshold. Instead, controller decreases the waveform adjustment parameter of the current inkjet by 20-8=12, and the cumulative sum is decreased by 18-12=6. The controller 50 modifies the image pixel offset by one pixel in the process direction to compensate for the waveform adjustment.

During process 200, the controller 50 stores the modified image data correction parameter for the next inkjet with the image data correction parameter data 62 in the memory 52 and stores the modified firing signal waveform amplitude parameter with the firing signal waveform parameters 64 in the memory 52 (block 224). The process 200 continues as describe above with reference to blocks 204-224 for additional inkjets (block 220). After processing all of the inkjets (block 220), the controller 50 uses the modified image data correction parameters and firing signal waveform parameters that are stored in the memory 52 to operate the inkjets with improved process direction registration during a printing operation (block 228).

The modification of the waveform parameters during process 200 is referred to as an error diffusion process because the controller 50 is monitoring the total magnitude in the cumulative sum of how far the inkjet waveforms for a group of inkjets have changed from their identified waveform parameters. A deviation for a group of neighboring inkjets produces in a change of mass of the ejected drops for the multiple inkjets, which produces light or dark streaks in printed images. By changing the image pixel offset selective, the error diffusion process ensures that the change in the waveform parameter for a group of inkjets remains below a threshold, a threshold that controls the change in the image density.

For some inkjets, the error diffusion process produces a modification to the waveform parameter value that is larger than the maximum waveform parameter value limit from the process 100 that limits changes to the ink drop mass of ink drops that are ejected from the inkjets. The controller 50 applies the larger changes to the individual inkjets because even though individual inkjets may experience variations in the sizes of printed ink drops, the process 200 prevents groups of neighboring inkjets in the printhead from printing ink drops that are either larger or smaller than the normalized ink drop size for the printhead. Even if an individual inkjet prints somewhat larger or smaller ink drops, the error diffusion process 200 reduces or eliminates the perceptible image artifacts that occur when multiple neighboring inkjets each print ink drops with a drop size that diverges from the normalized printhead drop size. Since the controller 50 also modifies the image data correction parameters that are associated with inkjets that receive modified firing signal waveform amplitude parameters, the process 200 maintains the process direction registration of the inkjets in the printhead.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating an inkjet printer comprising:

moving with a transport an image receiving surface in a process direction past a plurality of inkjets in at least one printhead, the plurality of inkjets being arranged in a cross-process direction;

ejecting a plurality of ink drops from the plurality of inkjets to form a printed test pattern on the image receiving surface;

generating with an optical sensor image data of the printed test pattern;

identifying with a controller a plurality of locations of a plurality of printed marks in the test pattern from the image data, each printed mark being formed by one inkjet in the plurality of inkjets;

identifying with the controller a process direction offset for each inkjet in the plurality of inkjets with reference to the location of each printed mark in the test pattern formed by each inkjet and a predetermined location on the image receiving surface;

modifying with the controller an image data correction parameter associated with image data that correspond to each inkjet in the plurality of inkjets to reduce a first portion of the identified process direction offset for each inkjet;

modifying with the controller a firing signal waveform parameter associated with each inkjet in the plurality of inkjets to reduce a second portion of the identified process direction offset for each inkjet; and storing with the controller the modified image data correction parameters and the modified firing signal waveform parameters in a memory for use in operating the plurality of inkjets to eject ink drops with reduced process direction offset between the ink drops ejected by the plurality of inkjets.

2. The method of claim 1 further comprising:

identifying with the controller a first integer pixel offset corresponding to a first portion of the process direction offset for one inkjet in the plurality of inkjets, each pixel having a predetermined length in the process direction;

identifying with the controller a first fractional pixel offset corresponding to a second portion of the process direction offset for the one inkjet;

modifying with the controller the image data correction parameter to reduce the process direction offset for the one inkjet by a distance corresponding to the first integer pixel offset; and modifying with the controller the firing signal waveform parameter to reduce the process direction offset for the one inkjet by a distance corresponding to the first fractional pixel offset.

3. The method of claim 2, the modification of the image data correction parameter and the firing signal waveform further comprising:

identifying with the controller a second integer pixel offset that differs from the first integer pixel offset by one pixel in response to the modification of the firing signal waveform parameter being above a predetermined maximum waveform parameter level or being below a predetermined minimum firing signal waveform parameter level;

identifying with the controller a second fractional pixel offset corresponding to a difference between the one pixel and the first fractional pixel offset for the one inkjet;

modifying with the controller the image data correction parameter to reduce the process direction offset for the one inkjet by a distance corresponding to the second integer pixel offset instead of the first integer pixel offset; and modifying with the controller the firing signal waveform parameter to reduce the process direction offset for the one inkjet by a distance corresponding to the second fractional pixel offset instead of the first fractional pixel offset.

4. The method of claim 3 further comprising:

identifying with the controller the second integer pixel offset having a magnitude that is one pixel greater than the first integer pixel offset in response to the modification of the firing signal waveform parameter corresponding to an increase in the waveform parameter of the firing signal above the predetermined maximum level; and identifying with the controller the second fractional pixel offset corresponding to a reduction in the waveform parameter of the firing signal, the second fractional pixel offset having a magnitude that is a difference between the one pixel and the first fractional pixel offset.

5. The method of claim 3 further comprising:

identifying with the controller the second integer pixel offset having a magnitude that is one pixel less than the first integer pixel offset in response to a decrease in the waveform parameter of the firing signal below the predetermined minimum level; and identifying with the controller the second fractional pixel offset corresponding to an increase in the waveform parameter of the firing signal, the second fractional pixel offset having a magnitude that is a difference between the one pixel and the first fractional pixel offset.

6. The method of claim 2, the modification of the firing signal waveform parameter further comprising:

identifying with the controller a plurality of differences between the modified firing signal waveform parameter for each inkjet in the plurality of inkjets and a predetermined waveform parameter for each inkjet in the plurality of inkjets;

identifying with the controller a cumulative sum of the plurality of differences;

identifying with the controller a second integer pixel offset that differs from the first integer pixel offset by one pixel for one inkjet in the plurality of inkjets in response to the magnitude of the identified cumulative sum exceeding a predetermined threshold;

modifying with the controller the image data correction parameter for the one inkjet by the second integer pixel offset instead of the first integer pixel offset;

identifying with the controller a second fractional pixel offset corresponding to a difference between the one pixel and the first fractional pixel offset for the one inkjet; and modifying with the controller the firing signal waveform parameter for the one inkjet by the second fractional pixel offset instead of the first integer pixel offset.

7. The method of claim 6 wherein the cumulative sum is a sum of the difference between the modified waveform parameter and the predetermined waveform parameter for each inkjet in a series of inkjets between a first inkjet in the plurality of inkjets and a second inkjet in the plurality of inkjets.

8. The method of claim 2, the modification of the firing signal waveform parameter further comprising:

modifying with the controller an amplitude parameter of the firing signal waveform to reduce the process direction offset by an amount corresponding to the first fractional pixel offset.

9. The method of claim 2, the modification of the firing signal waveform parameter further comprising:

modifying with the controller a pulse width parameter of the firing signal waveform to reduce the process direction offset by an amount corresponding to the first fractional pixel offset.

10. An inkjet printer comprising:

a printhead with a plurality of inkjets arranged in a cross-process direction and configured to eject ink drops onto an image receiving surface that moves in a process direction;

a transport configured to move the image receiving surface in the process direction past the printhead;

an optical sensor configured to generate image data of the ink drops from the printhead that are formed on the image receiving surface;

a memory configured to store a plurality of image data correction parameters and a plurality of firing signal waveform parameters, each image data correction parameter and firing signal waveform parameter being associated with one inkjet in the plurality of inkjets; and a controller operatively connected to the printhead, the optical sensor, and the memory, the controller being configured to:

operate the transport to move the image receiving surface in the process direction past the plurality of inkjets in the printhead;

generate a plurality of electrical firing signals for the plurality of inkjets in the printhead to eject a plurality of ink drops to form a printed test pattern on the image receiving surface;

generate with the optical sensor image data of the printed test pattern;

identify a plurality of locations of a plurality of printed marks in the test pattern from the image data, each printed mark being formed by one inkjet in the plurality of inkjets;

identify a process direction offset for each inkjet in the plurality of inkjets with reference to the location of each printed mark in the test pattern formed by each inkjet and a predetermined location on the image receiving surface;

modify an image data correction parameter associated with image data that correspond to each inkjet in the plurality of inkjets to reduce a first portion of the identified process direction offset for each inkjet;

modify a firing signal waveform parameter associated with each inkjet in the plurality of inkjets to reduce a second portion of the identified process direction offset for each inkjet; and store the modified image data correction parameters and the modified firing signal waveform parameters in the memory for use in operating the plurality of inkjets to eject ink drops with reduced process direction offset between the ink drops ejected by the plurality of inkjets.

11. The printer of claim 10, the controller being further configured to:

identify a first integer pixel offset corresponding to a first portion of the process direction offset for one inkjet in the plurality of inkjets, each pixel having a predetermined length in the process direction;

identify a first fractional pixel offset corresponding to a second portion of the process direction offset for the one inkjet;

modify the image data correction parameter to reduce the process direction offset for the one inkjet by a distance corresponding to the first integer pixel offset; and modify the firing signal waveform parameter to reduce the process direction offset for the one inkjet by a distance corresponding to the first fractional pixel offset.

12. The printer of claim 11, the controller being further configured to:

identify a second integer pixel offset that differs from the first integer pixel offset by one pixel in response to the modification of the firing signal waveform parameter being above a predetermined maximum waveform parameter level or being below than a predetermined minimum firing signal waveform parameter level;

identify a second fractional pixel offset corresponding to a difference between the one pixel and the first fractional pixel offset for the one inkjet;

modify the image data correction parameter to reduce the process direction offset for the one inkjet by a distance corresponding to the second integer pixel offset instead of the first integer pixel offset; and modify the firing signal waveform parameter to reduce the process direction offset for the one inkjet by a distance corresponding to the second fractional pixel offset instead of the first fractional pixel offset.

13. The printer of claim 12 the controller being further configured to:

identify the second integer pixel offset having a magnitude that is one pixel greater than the first integer pixel offset in response to the modification of the firing signal waveform parameter corresponding to an increase in the waveform parameter of the firing signal above the predetermined maximum level; and identify the second fractional pixel offset corresponding to a reduction in the waveform parameter of the firing signal, the second fractional pixel offset having a magnitude that is a difference between the one pixel and the first fractional pixel offset.

14. The printer of claim 12 the controller being further configured to:

identify the second integer pixel offset having a magnitude that is one pixel less than the first integer pixel offset in response to a decrease in the waveform parameter of the firing signal below the predetermined minimum level; and identify the second fractional pixel offset corresponding to an increase in the waveform parameter of the firing signal, the second fractional pixel offset having a magnitude that is a difference between the one pixel and the first fractional pixel offset.

15. The printer of claim 11, the controller being further configured to:

identify a plurality of differences between the modified firing signal waveform parameter for each inkjet in the plurality of inkjets and a predetermined waveform parameter for each inkjet in the plurality of inkjets;

identify a cumulative sum of the plurality of differences;

identify a second integer pixel offset that differs from the first integer pixel offset by one pixel for one inkjet in the plurality of inkjets in response to the magnitude of the identified cumulative sum exceeding a predetermined threshold;

modify the image data correction parameter for the one inkjet by the second integer pixel offset instead of the first integer pixel offset;

identify a second fractional pixel offset corresponding to a difference between the one pixel and the first fractional pixel offset for the one inkjet; and modify the firing signal waveform parameter for the one inkjet by the second fractional pixel offset instead of the first integer pixel offset.

16. The printer of claim 15 wherein the cumulative sum is a sum of the difference between the modified waveform parameter and the predetermined waveform parameter for each inkjet in a series of inkjets between a first inkjet in the plurality of inkjets and a second inkjet in the plurality of inkjets.

17. The printer of claim 11, the controller being further configured to:

modifying an amplitude parameter of the firing signal waveform to reduce the process direction offset by an amount corresponding to the first fractional pixel offset.

18. The printer of claim 11, the controller being further configured to:

modify a pulse width parameter of the firing signal waveform to reduce the process direction offset by an amount corresponding to the first fractional pixel offset.

* * * * *